US010239106B2

(12) United States Patent
Kunimoto et al.

(10) Patent No.: US 10,239,106 B2
(45) Date of Patent: Mar. 26, 2019

(54) SPINNING METHOD AND SPINNING APPARATUS

(71) Applicants: Yukitaka Kunimoto, Hamamatsu (JP); Satoshi Shionoya, Okazaki (JP); Takashi Yamamoto, Toyota (JP)

(72) Inventors: Yukitaka Kunimoto, Hamamatsu (JP); Satoshi Shionoya, Okazaki (JP); Takashi Yamamoto, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 277 days.

(21) Appl. No.: 14/781,151

(22) PCT Filed: Apr. 1, 2014

(86) PCT No.: PCT/IB2014/000533
§ 371 (c)(1),
(2) Date: Sep. 29, 2015

(87) PCT Pub. No.: WO2014/162197
PCT Pub. Date: Oct. 9, 2014

(65) Prior Publication Data

US 2016/0052036 A1 Feb. 25, 2016

(30) Foreign Application Priority Data

Apr. 3, 2013 (JP) ..... 2013-077845

(51) Int. Cl.
*B21D 22/14* (2006.01)
*B21D 22/16* (2006.01)
*B21D 22/18* (2006.01)

(52) U.S. Cl.
CPC ..... *B21D 22/14* (2013.01); *B21D 22/16* (2013.01); *B21D 22/18* (2013.01)

(58) Field of Classification Search
CPC ..... B21D 22/14; B21D 22/16; B21D 22/18
See application file for complete search history.

(56) References Cited

U.S. PATENT DOCUMENTS 4,143,535 A 3/1979 Bouman
5,937,516 A * 8/1999 De Sousa ..... B21D 22/14 29/508

(Continued)

FOREIGN PATENT DOCUMENTS

EP 1 302 253 A2 4/2003
EP 1 302 253 A3 4/2003

(Continued)

OTHER PUBLICATIONS

International Search Report and Written Opinion dated Jun. 23, 2014 in PCT/IB2014/000533.

*Primary Examiner* — Pradeep C Battula
(74) *Attorney, Agent, or Firm* — Oblon, McClelland, Maier & Neustadt, L.L.P.

(57) ABSTRACT

A spinning method includes supporting a supported portion of a cylindrical work by a work supporting portion; pressing a first roller of a spinning head against a processed portion of the work while revolving the first roller; and performing a forming process that points a tube axis of the processed portion of the work in a given direction by pressing the first roller and a second roller in which a plane of revolution thereof is provided in a different position, in a rotational axis direction of a spindle of the spinning head, than a plane of revolution of the first roller, while revolving the first roller and the second roller, and moving the work supporting portion relative to the spinning head or moving the spinning head relative to the work supporting portion, while the first roller and the second roller work in cooperation with each other to retain the work.

7 Claims, 4 Drawing Sheets

(56) References Cited

U.S. PATENT DOCUMENTS 6,067,833 A * 5/2000 Irie ..... B21D 22/14 72/101
6,216,512 B1 * 4/2001 Irie ..... B21D 22/14 72/120
6,233,993 B1 * 5/2001 Irie ..... B21D 41/04 72/121
6,381,843 B1 * 5/2002 Irie ..... F01N 3/2853 29/515
6,386,010 B1 * 5/2002 Irie ..... B21D 22/14 72/100
6,442,988 B1 * 9/2002 Hamstra ..... B21D 22/16 72/100
6,467,322 B2 * 10/2002 Nogami ..... B21D 22/14 72/121
6,591,498 B2 * 7/2003 Irie ..... F01N 3/2853 29/515
6,729,354 B2 * 5/2004 Ishizu ..... B21D 22/14 138/109
6,769,281 B2 * 8/2004 Irie ..... F01N 3/2853 29/890
6,823,704 B2 * 11/2004 Nakamura ..... B21D 22/14 72/121
6,990,841 B2 * 1/2006 Desousa ..... B21D 22/14 72/101
7,013,690 B2 * 3/2006 Massee ..... B21D 22/14 72/121
7,131,305 B2 * 11/2006 Desousa ..... B21D 22/14 72/121
7,143,619 B2 * 12/2006 Morikawa ..... B21D 22/14 72/121
7,251,974 B2 * 8/2007 Massee ..... B21D 22/14 72/101
7,963,138 B2 * 6/2011 Okada ..... B21D 22/14 72/121
8,091,396 B2 * 1/2012 Irie ..... B21D 22/18 72/121
8,117,877 B2 * 2/2012 Massee ..... B21D 22/14 72/101
8,635,898 B2 * 1/2014 Karino ..... B21D 22/16 72/120
9,574,684 B1 * 2/2017 Fonte ..... B22D 13/04
2005/0257588 A1 11/2005 Lancaster
2008/0127699 A1 6/2008 Okada et al.

FOREIGN PATENT DOCUMENTS

EP 2 353 744 A1 8/2011
JP 57-112916 A 7/1982
JP 2000-94069 A 4/2000
JP 2001-25826 A 1/2001
JP 2003-10935 A 1/2003
JP 2006-181592 A 7/2006

* cited by examiner

SPINNING METHOD AND SPINNING APPARATUS

BACKGROUND OF THE INVENTION

1. Field of the Invention

The invention relates to a spinning method and a spinning apparatus suitable to be applied when integrally forming a member having a three-dimensionally complex cylindrical shape, such as an exhaust pipe of a vehicle for example, from a cylindrical work.

2. Description of Related Art

Japanese Patent Application Publication No. 2001-25826 (JP 2001-25826 A), for example, describes one such spinning method that reduces the diameter of a processed portion of a cylindrical work, by pressing approximately two to four rollers against an outer peripheral surface of the processed portion of the work while revolving the rollers, while a cylindrical work is being supported by a chuck or a clamping device.

However, with this kind of spinning method, processing is performed by pressing the rollers from the outside of the work toward the inside of the work (i.e., toward the axis of the work). Therefore, normally, forming beyond the outer shape of the work (i.e., processing to form the axis of the work in a given direction without being limited to the area within the outer shape (the cylindrical shape) of the work), e.g., an offsetting process, is unable to be performed on the work.

SUMMARY OF THE INVENTION

The invention thus provides a spinning method that makes it possible to perform forming beyond the outer shape of the work. The invention also provides a spinning apparatus suitable for implementing such a spinning method.

A first aspect of the invention relates to a spinning method. This spinning method includes supporting a supported portion of a cylindrical work by a work supporting portion; pressing a first roller of a spinning head against a processed portion of the work while revolving the first roller; and performing a forming process that points a tube axis of the processed portion of the work in a given direction by pressing the first roller and a second roller in which a plane of revolution thereof is provided in a different position, in a rotational axis direction of a spindle of the spinning head, than a plane of revolution of the first roller, while revolving the first roller and the second roller, arid moving the work supporting portion relative to the spinning head or moving the spinning head relative to the work supporting portion, while the first roller and the second roller work in cooperation with each other to retain the work.

According to this aspect, the forming process that points the tube axis of the processed portion of the work in a given direction is performed in the spinning process that is performed on the cylindrical work. As a result, forming beyond the outer shape of the cylindrical work is able to be performed on the cylindrical work.

Also, in the aspect described above, the spinning method may also include performing an offsetting process in which the tube axis of the processed portion of the work is offset from a tube axis of the supported portion of the work by moving the processed portion of the work relative to the work supporting portion, by moving the work supporting portion or moving the spinning head.

According to this aspect, the offsetting process in which the tube axis of the processed portion of the work is offset from the tube axis of the supported portion of the work is performed. As a result, forming beyond the outer shape of the cylindrical work is able to be performed on the cylindrical work.

Also, in the aspect described above, the forming process may include inclining the tube axis of the processed portion of the work with respect to a tube axis of the supported portion of the work, by appropriately swinging the work supporting portion while the supported portion of the work is supported by the work supporting portion.

According to this aspect, the tube axis of the processed portion of the work is inclined with respect to the tube axis of the supported portion of the work, when the forming process is performed on the cylindrical work. As a result, forming beyond the outer shape of the cylindrical work is able to be performed on the cylindrical work.

Also, in the aspect described above, the first roller may be provided in plurality at substantially equiangular intervals on a circumference of a circle that is centered around the rotational axis of the spindle; and the second roller may be provided in plurality at substantially equiangular intervals on a circumference of a circle that is centered around the rotational axis of the spindle, in a manner arranged alternately with the first rollers when viewed from the rotational axis direction of the spindle.

According to this aspect, a plurality of the first rollers and a plurality of the second rollers are provided at substantially equiangular intervals on the circumference of a circle that is centered around the rotational axis of the spinning head. Therefore, the support points of the first rollers and the second rollers with respect to the work increase, and the processed portion of the work is pressed on substantially evenly by the first rollers and the second rollers. As a result, the processing accuracy of the work is able to be improved.

Also, in the aspect described above, the first roller and the second roller may be configured to be able to move independent of each other in a radial direction with respect to the rotational axis of the spindle.

According to this aspect, the first roller and the second roller are configured to be able to move independent of each other in a radial direction with respect to the rotational axis of the spindle. Therefore, the first roller and the second roller are able to be made to reliably contact the outer peripheral surface of the work, according to the processing shape of the work, when performing the forming process on the cylindrical work. Therefore, the processing accuracy of the work is able to be improved even if the processing shape of the work is complex.

Also, in the aspect described above, the spinning method may also include reducing a diameter of the processed portion of the work by appropriately reducing a revolution diameter of the first roller and the second roller, with the forming process.

According to this aspect, the processed portion of the work is able to be reduced in diameter, with the forming process on the cylindrical work. Therefore, the forming process and the diameter reducing process on the work are simultaneously performed, so productivity improves.

A second aspect of the invention relates to a spinning apparatus. This spinning apparatus includes a work supporting portion that supports a supported portion of a cylindrical work; a first roller that is provided on a spinning head and that is pressed against a processed portion of the work while being revolved; and a second roller in which a plane of revolution thereof is provided in a different position, in a rotational axis direction of a spindle of the spinning head, than a plane of revolution of the first roller. The first roller and the second roller work in cooperation with each other to retain the work. The first roller and the second roller are pressed against the work while revolving, and the work supporting portion moves relative to the spinning head or the spinning head moves relative to the work supporting portion, while the work is being retained.

According to this aspect, effects similar to those obtained by the first aspect of the invention are able to be obtained.

Also, in the aspect described above, the work supporting portion may be configured such that an offsetting process, in which a tube axis of the processed portion of the work is offset from a tube axis of the supported portion of the work by the processed portion of the work being moved relative to the work supporting portion, is performed by the work supporting portion or the spinning head being moved.

According to this aspect, effects similar to those obtained by the first aspect of the invention, as well as the aspects accompanying the first aspect, are able to be obtained.

In the aspect described above, the work supporting portion may swing such that a tube axis of the processed portion of the work is inclined with respect to a tube axis of the supported portion of the work.

According to this aspect, effects similar to those obtained by the first aspect of the invention, as well as the aspects accompanying the first aspect, are able to be obtained.

In the aspect described above, the first roller may be provided in plurality at substantially equiangular intervals on a circumference of a circle that is centered around the rotational axis of the spindle. Also, the second roller may be provided in plurality at substantially equiangular intervals on a circumference of a circle that is centered around the rotational axis of the spindle, in a manner arranged alternately with the first rollers when viewed from the rotational axis direction of the spindle.

According to this aspect, effects similar to those obtained by the first aspect of the invention, as well as the aspects accompanying the first aspect, are able to be obtained.

In the aspect described above, the first roller and the second roller may be configured to be able to move independent of each other in a radial direction with respect to the rotational axis of the spindle.

According to this aspect, effects similar to those obtained by the first aspect of the invention, as well as the aspects accompanying the first aspect, are able to be obtained.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will be described.

First Example Embodiment of the Invention

Figure 1A:
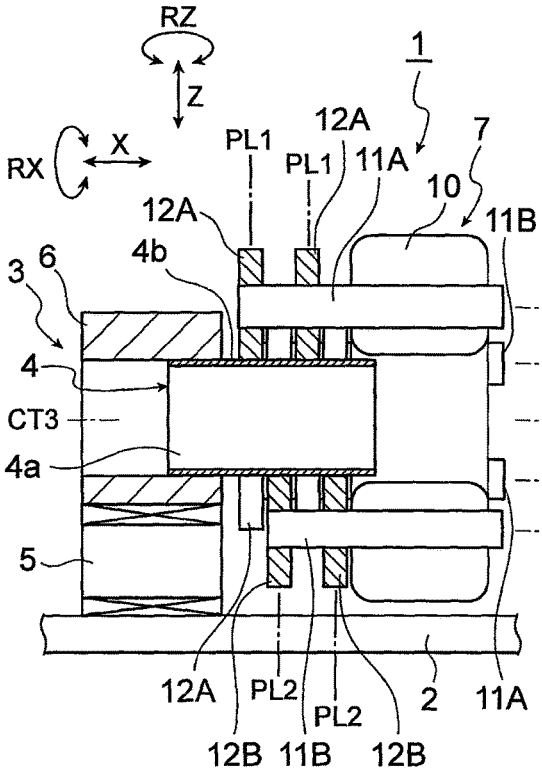
FIG. 1A is a front view of a spinning apparatus, and illustrates a work preparation process and a roller contact process of a spinning method according to a first example embodiment of the invention.

FIGS. 1A to 3 are views of a first example embodiment of the invention. FIG. 1A is a sectional view of rollers (first rollers and second rollers) and the like taken along line IA-IA in FIG. 1B. A spinning apparatus 1 according to the first example embodiment includes a table 2 that is arranged horizontally, as shown in FIG. 1A. A work support base 3 that serves as a work supporting portion is attached onto the table 2 in such a manner as to be able to move in three axis directions (i.e., an X direction, a Y direction, and a Z direction), as well as swing around an axis in the X direction (i.e., in a RX direction), around an axis in the Y direction (i.e., in a RY direction), and around an axis in the Z direction (i.e., in a RZ direction), while supporting a cylindrical work 4. This work support base 3 is formed by a base 5 and a chuck 6. That is, the base 5 is supported so as to be able to move in three axis directions (i.e., the X direction, the Y direction, and the Z direction), on the table 2. The chuck 6 that is able to grip the work 4 is mounted onto the base 5 so as to be able to swing around an axis in the X direction (i.e., the RX direction), an axis in the Y direction (i.e., the RY direction), and an axis in the Z direction (i.e., the RZ direction).

Also, a spinning head 7 is arranged near (to the right in FIG. 1A) the work support base 3. The spinning head 7 is formed by a spindle base, not shown, a spindle 10, three first support shafts 11A, three second support shafts 11B, three pairs (i.e., six) of first rollers 12A, and three pairs (i.e., six) of second rollers 12B and the like (see FIGS. 1A and 1B). Here, the three pairs of first rollers 12A are provided at equiangular intervals (i.e., 120° intervals) on a circumference of a circle C1 that is centered around a rotational axis CT1 of the spindle 10. Also, the three pairs of second rollers 12B are arranged alternately with the three pairs of first rollers 12A (i.e., separated from the first rollers 12A by 60° each) when viewed from direction of the rotational axis CT1 of the spindle 10. Also, the three pairs of second rollers 12B are provided at equiangular intervals (i.e., 120° intervals) on the circumference of the circle C1 that is centered around the rotational axis CT1 of the spindle 10.

Figure 1B:
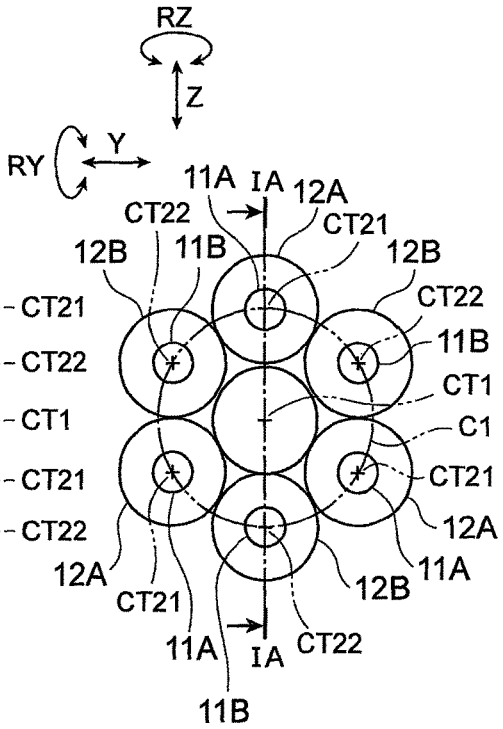
FIG. 1B is a right side view of a spinning head, and illustrates the work preparation process and the roller contact process of the spinning method according to the first example embodiment of the invention.
Figure 1C:
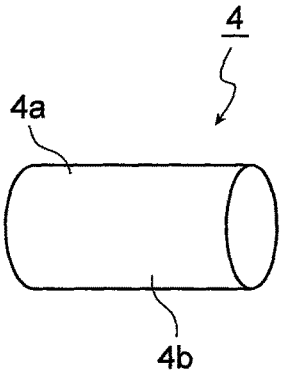
FIG. 1C is a perspective view of a work before being processed, and illustrates the work preparation process and the roller contact process of the spinning method according to the first example embodiment of the invention.

That is, the spindle base, not shown, is provided upright on the table 2. The annular spindle 10 is supported, in a manner so as to be able to rotate about the rotational axis CT1 by driving means, not shown, in a position facing the chuck 6, as shown in FIG. 1A, on a side surface of the spindle base. Together with the spindle 10, the six support shafts 11 (i.e., the three first support shafts 11A and the three second support shafts 11B) are arranged at equiangular intervals (i.e., 60° intervals) on the circumference of the circle C1 that is centered around the rotational axis CT1, as shown in FIG. 1B. The first support shafts 11A and the second support shafts 11B are configured to be able to move independent of each other in the radial direction of the rotational axis CT1 of the spindle 10. One pair (i.e., two) of the first rollers 12A that have the same diameter is supported by each of the first support shafts 11A, in a manner so as to be able to rotate about axes CT21 of the first support shafts 11A. These two first rollers 12A are attached in different positions in the direction of the rotational axis CT1 of the spindle 10, as shown in FIG. 1A. Also, one pair (i.e., two) of the second rollers 12B that have the same diameter is supported by each of the second support shafts 11B, in a manner so as to be able to rotate about axes CT22 of the second support shafts 11B. These two second rollers 12B are attached in different positions in the direction of the rotational axis CT1 of the spindle 10; as shown in FIG. 1A. A plane of revolution PL1 of the first rollers 12A and a plane of revolution PL2 of the second rollers 12B are provided in different locations in the rotational axis CT1 of the spindle 10, as shown in FIG. 1A. The first rollers 12A and the second rollers 12B have the same diameter, as shown in FIG. 1B.

Figure 3:
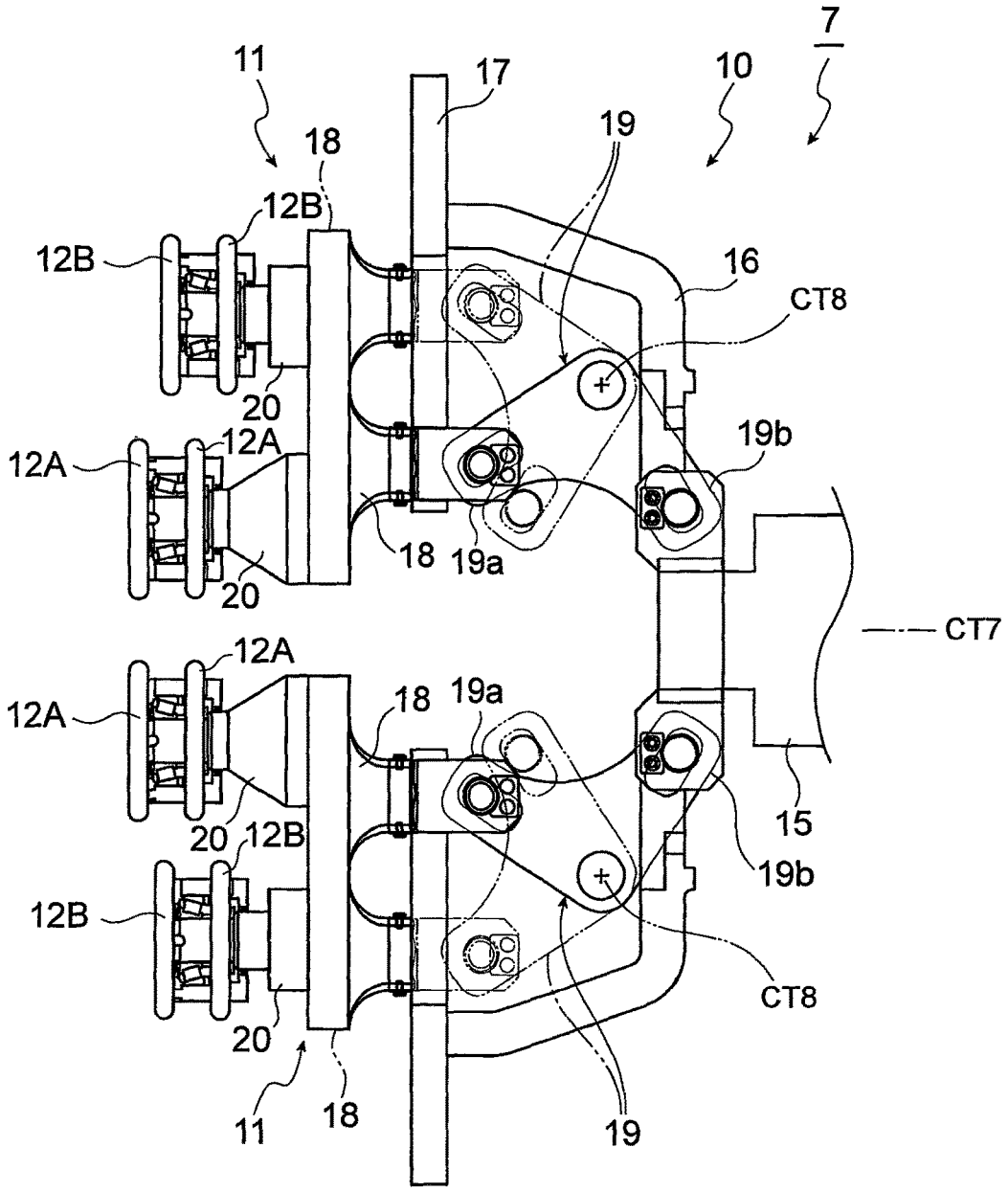
FIG. 3 is a front sectional view of the specific structure of the spinning head of the spinning apparatus according to the first example embodiment of the invention.

More specifically, the spinning head 7 is such that the spindle 10 is formed by a housing 16 and a faceplate 17, and the support shafts 11 (i.e., the first support shafts 11A and the second support shafts 11B) are formed by sliders 18 and roller holders 20, as shown in FIG. 3.

That is, this spinning head 7 has a main shaft 15 that is supported horizontally, as shown in FIG. 3. The housing 16 is attached to the main shaft 15 in a manner so as to be able to rotate about an axis CT7 of the main shaft 15. The annular faceplate 17 is fixed to the housing 16 such that a surface of the faceplate 17 is perpendicular to the axis CT7 of the main shaft 15, and the center of the faceplate 17 is aligned with the axis CT7. Six sliders 18 are arranged on the faceplate 17 at equiangular intervals (i.e., 60° intervals) on the circumference of a circle that is centered around the center of the faceplate 17, i.e., the axis CT7 of the main shaft 15. Each of the sliders 18 is configured to be able to move in the radial direction of the faceplate 17 by pivoting a boomerang-shaped slide ring 19 with driving means, not shown, as indicated by the solid lines and alternate long and two short dashes lines in FIG. 3. That is, each of the slide rings 19 is supported in a manner so as to be able to rotate about a predetermined rotational axis CT8. The slider 18 is connected to one end 19*a* of the slide ring 19, and the driving means is connected to the other end 19*b* of the slide ring 19. The slider 18 is then able to be moved in the radial direction of the faceplate 17 by moving the other end 19*b* of the slide ring 19 in the horizontal direction using the driving means. Also, one roller holder 20 is fixed to each slider 18. One pair (i.e., two) of the rollers 12 (i.e., the first rollers 12A or the second rollers 12B) is rotatably supported by each roller holder 20.

The spinning apparatus 1 is configured as described above, so the procedure for performing spinning on the cylindrical work 4 using this spinning apparatus 1 is as described below.

First, in a work preparation process, a supported portion 4*a* of the work 4 is gripped by the chuck 6 of the work support base 3, as shown in FIG. 1A, while the six support shafts 11 (i.e., the three first support shafts 11A and the three second support shafts 11B) are farthest away from the rotational axis CT1 of the spindle 10 in the radial direction of the spindle 10. As a result, the work 4 is in a state supported horizontally with an axis CT3 thereof aligned with the rotational axis CT1 of the spindle 10.

Next, a roller contact process is performed. In this process, the six support shafts 11 are moved toward the rotational axis CT1 of the spindle 10 in the radial direction of the spindle 10. As a result, the six pairs of rollers 12 (i.e., the three pairs of first rollers 12A and the three pairs of second rollers 12B) contact the outer peripheral surface of the work 4. As a result, the work 4 is in a state retained by the three pairs of first rollers 12A and the three pairs of second rollers 12B working in cooperation with each other. The six support shafts 11 are arranged at equiangular intervals on the circumference of the circle C1 that is centered around the rotational axis CT1 of the spindle 10, just as described above. Therefore, the six pairs of rollers 12 are also arranged at equiangular intervals around the work 4.

Finally, an offsetting and diameter reducing process is performed. In this process, the spindle 10 is rotated about the rotational axis CT1. As a result, the six pairs of rollers 12 revolve at a predetermined rotation rate about the rotational axis CT1. As a result, the rollers 12 revolve around the work 4 while spinning with respect to the outer peripheral surface of the processed portion 4*b* of the work 4.

In this state, the six pairs of rollers 12 are moved toward the center in the radial direction of the spindle 10, and the work support base 3 is moved away from the spinning head 7 in the X direction. Further, simultaneously, the work support, base 3 is moved upward in the Z direction.

Figure 2A:
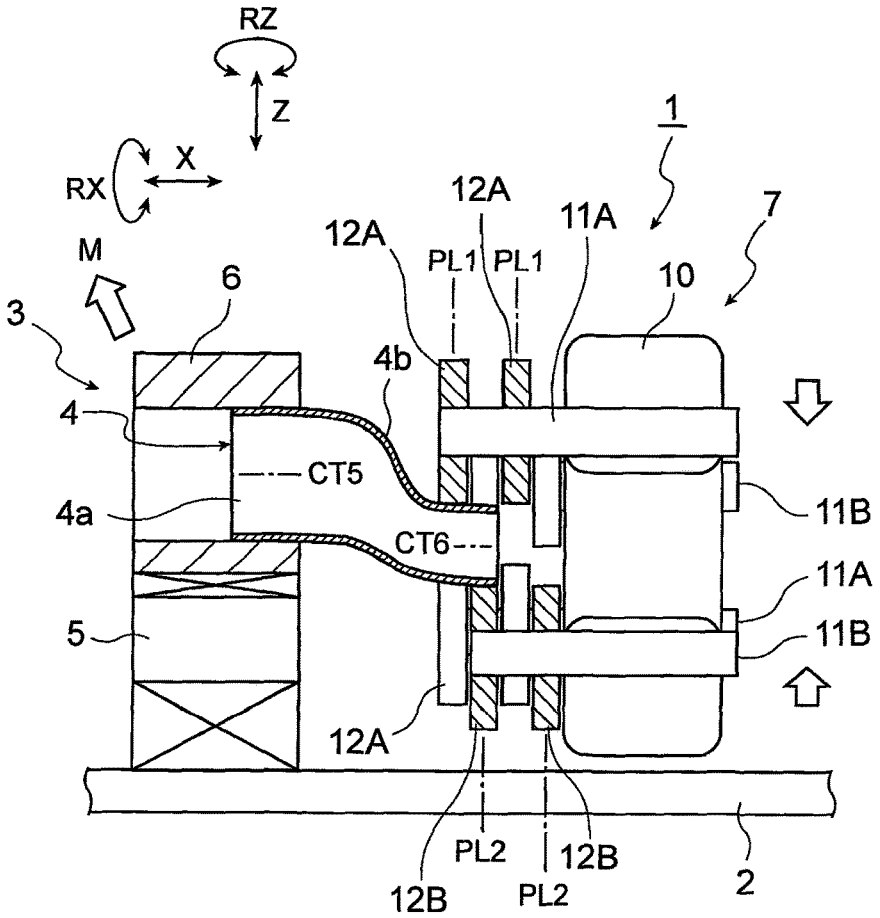
FIG. 2A is a front view of the spinning apparatus, and illustrates an offsetting and diameter reducing process of the spinning method according to the first example embodiment of the invention.
Figure 2B:
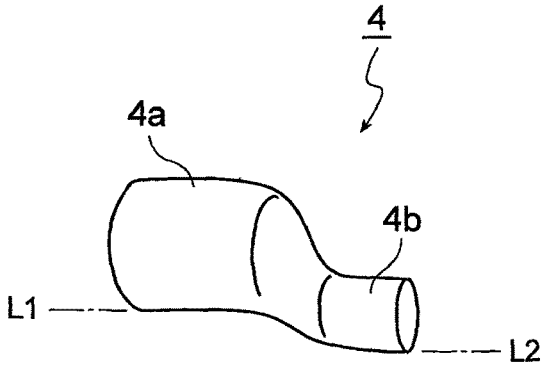
FIG. 2B is a perspective view of a target shape of the work in this offsetting and diameter reducing process of the spinning method according to the first example embodiment of the invention, and illustrates this offsetting and diameter reducing process.

As a result, the supported portion 4*a* of the work 4 moves upward at an angle (in the direction of arrow M in FIG. 2A) while the processed portion 4*b* of the work 4 remains in the original position. Therefore, an offsetting process in which a tube axis CT5 of the supported portion 4*a* is offset upwards from a tube axis CT6 of the processed portion 4*b* is performed, by the six pairs of rollers 12 that are revolving at a predetermined rotation rate while retaining the work 4. Simultaneously, a diameter reducing process in which the diameter of the processed portion 4*b* is made smaller than the diameter of the supported portion 4*a* is performed. As a result, forming in which an outside line L2 of the processed portion 4*b* is positioned to the outside (i.e., on the lower side in FIG. 2B) of an outside line L1 of the supported portion 4*a*, that is, forming beyond the outer shape of the work 4, is able to be performed on the cylindrical work 4, as shown in FIG. 2B. Moreover, the offsetting process and the diameter reducing process that are performed on the work 4 are performed simultaneously, so productivity is able to be improved.

At this time, the six pairs of rollers 12 are arranged at equiangular intervals around the work 4, just as described above. Therefore, the support points of the rollers 12 with respect to the work 4 increase, and the processed portion 4*b* of the work 4 is pressed on substantially evenly by these rollers 12. As a result, the processing accuracy of the work 4 is able to be improved.

With this, the spinning process performed on the work 4 ends.

In this way, in the spinning head 7, the plane of revolution PL1 of the first rollers 12A and the plane of revolution PL2 of the second rollers 12B are provided in different positions in the direction of the rotational axis CT1 of the spindle 10. Therefore, when spinning the cylindrical work 4, the work 4 is firmly retained by the first rollers 12A and the second rollers 12B at two points that are separated from each other in the direction of the rotational axis CT1 of the spindle 10, i.e., in the length direction of the work 4. Therefore, the retained state of the work 4 can be ensured and the rigidity of the work 4 can be increased, compared to when these planes of revolution PL1 and PL2 are provided in the same position in the direction of the rotational axis CT1 of the spindle 10. As a result, in the spinning process that is performed on the cylindrical work 4, an offsetting process in which the tube axis CT6 of the processed portion 4*b* of the work 4 is offset from the tube axis CT5 of the supported portion 4*a* of the work 4 can be performed. Therefore, forming beyond the outside shape of the cylindrical work 4 can be performed on the cylindrical work 4.

Also, in the spinning head 7, two of the first rollers 12A are mounted on each of the first support shafts 11A, and two of the second rollers 12B are mounted on each of the second support shafts 11B, just as described above. Therefore, when performing the spinning process (i.e., performing the offsetting and diameter reducing process) on the work 4, the contact area between the rollers 12 and the work 4 is greater than it is when only one of each of the first rollers 12A and the second rollers 12B are provided. Therefore, the spinning process performed on the work 4 is able to be performed highly accurately and in a short period of time.

Furthermore, in the spinning head 7, the plane of revolution PL1 of the first rollers 12A and the plane of revolution PL2 of the second rollers 12B are provided in different positions in the direction of the rotational axis CT1 of the spindle 10, just as described above. Therefore, even if the diameter of the rollers 12 is large, the rollers 12 will not easily interfere with each other, so the degree of freedom in the design of the spinning head 7 is greater compared to when these planes of revolution PL1 and PL2 are provided in the same position in the direction of the rotational axis CT1 of the spindle 10.

Also, the work support base 3 swings around the axis in the X direction (i.e., around in the RX direction), the axis in the Y direction (i.e., around in the RY direction), and the axis in the Z direction (i.e., around in the RZ direction), just as described above. When spinning the work 4, the work support base 3 is swung appropriately according to the processing shape of the processed portion 4*b* of the work 4, while the supported portion 4*a* of the work 4 is supported by the work support base 3. Accordingly, the tube axis CT6 of the processed portion 4*b* of the work 4 is also able to be inclined with respect to the tube axis CT5 of the supported portion 4*a* of the work 4. As a result, it becomes possible to suitably bend the work 4 in a three-dimensional direction.

Also, the first support shafts 11A and the second support shafts 11B are configured to be able to move independent of each other in the radial direction with respect to the rotational axis CT1 of the spindle 10, just as described above. Therefore, the first rollers 12A and the second rollers 12B are able to be made to reliably contact the outer peripheral surface of the work 4, according to the processing shape of the work 4, when performing the offsetting process and the diameter reducing process on the cylindrical work 4. Therefore, the processing accuracy of the work 4 is able to be improved even if the processing shape of the work 4 is complex.

Second Example Embodiment of the Invention

Figure 4:
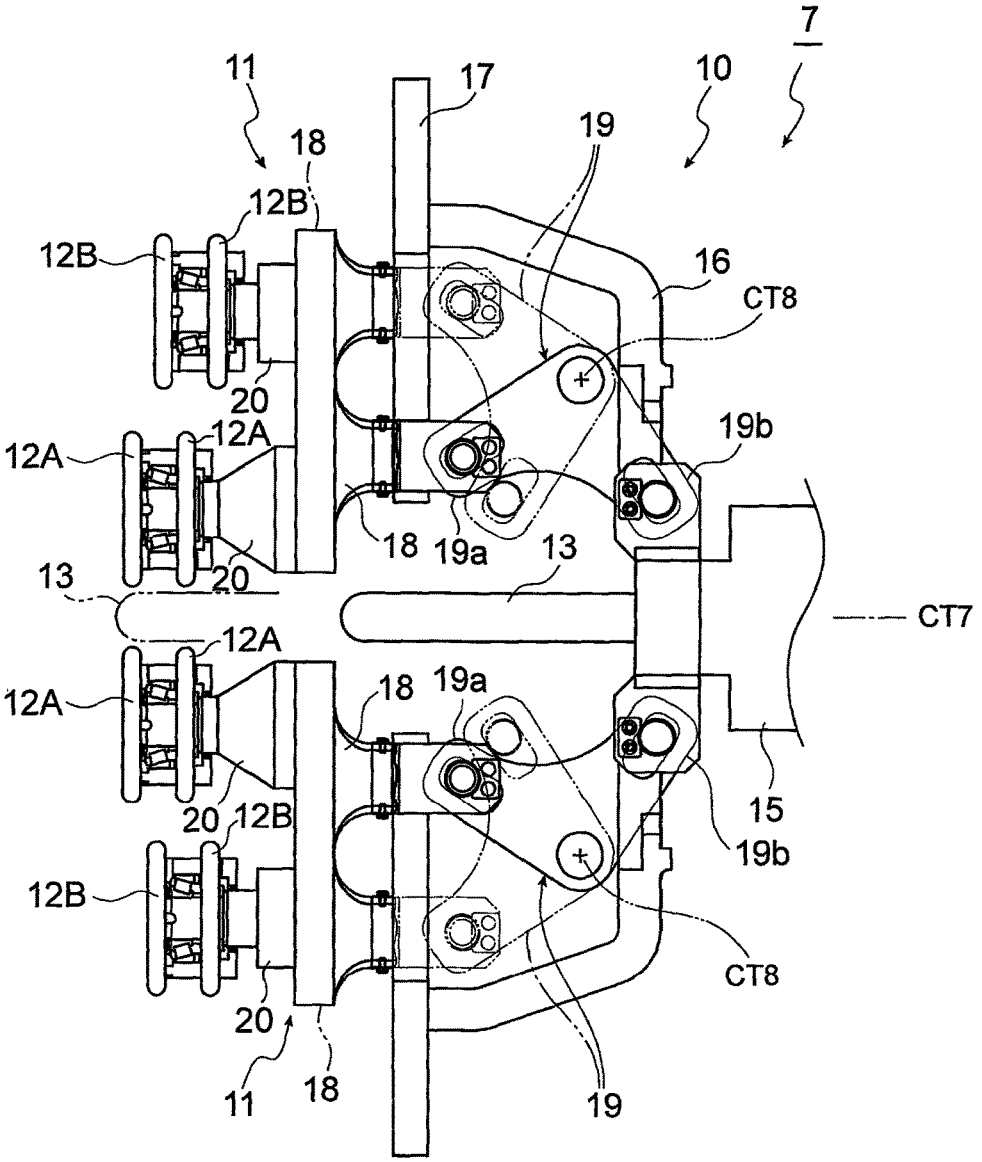
FIG. 4 is a front sectional view of the specific structure of a spinning head of a spinning apparatus according to a second example embodiment of the invention.

FIG. 4 is a view of a second example embodiment of the invention. In the spinning head 7 of the spinning apparatus 1 according to the second example embodiment, a generally pencil-shaped work-stabilizing core bar (mandrel) 13 of which an axis CT4 is positioned on the rotational axis CT1 of the spindle 10, i.e., on the axis CT7 of the main shaft 15, is attached to the spindle 10 in a manner so as to be able to advance and retreat in the direction of the rotational axis CT1 of the spindle 10 (i.e., the left-right direction in FIG. 4). The other structure is the same as that in the first example embodiment described above, so like members will be denoted by like reference characters and descriptions of these members will be omitted. Also, the procedure of the spinning method of the work 4 is also the same as it is in the first example embodiment described above.

Therefore, this second example embodiment displays similar operation and effects as those displayed by the first example embodiment described above. In addition, in the spinning process that is performed on the work 4 (i.e., in the offsetting and diameter reducing process), the core bar 13 is inserted inside the processed portion 4*b* of the work 4. As a result, even if the rigidity of the work 4 is low, oscillation that accompanies spinning of the work 4 is suppressed, so the work 4 can be processed with high accuracy.

Other Example Embodiments of the Invention

In the first and second example embodiments described above, a spinning head 7 configured such that the housing 16 is rotatably attached to the main shaft 15 is described. However, a structure in which the main shaft 15 rotates together with the housing 16 may also be employed. Also, in the first and second example embodiments described above, a case is described in which the work 4 is processed by moving the work support base 3 upward at an angle (i.e., in the X direction and the Z direction), in the spinning process (i.e., the offsetting and diameter reducing process) performed on the work 4. However, the work 4 may also be processed by moving the spinning head 7 downward at an angle, instead of moving the work support base 3 upward at an angle. That is, the work support base 3 side need only be moved relative to the spinning head 7 side. Alternatively, the processed portion 4*b* of the work 4 may be moved in another direction (such as a vertical direction or a horizontal direction) relative to the work support base 3 side.

Also, in the first and second example embodiments described above, a spinning head 7 having six support shafts 11 (i.e., the three first support shafts 11A and the three second support shafts 11B) is described. However, the number of support shafts 11 is not limited to six.

Further, in the first and second example embodiments described above, a case is described in which the first rollers 12A and the second rollers 12B have the same diameters. However, the first rollers 12A and the second rollers 12B may also have different diameters.

In the first and second example embodiments described above, a spinning head 7 in which two rollers 12 (12A and 12B) are provided on each support shaft 11 (11A and 11B) is described. However, the number of rollers 12 provided on the each support shaft 11 is not limited to two, but may of course also be one or three or more. When the number of rollers 12 increases, the contact area between the rollers 12 and the work 4 will increase in the spinning process (i.e., the offsetting and diameter reducing process) performed on the work 4. Therefore, the spinning process performed on the work 4 is able to be performed highly accurately and in a short period of time.

Also, in the first and second example embodiments described above, a spinning head 7 configured such that the rollers 12 are rotatably supported by the support shafts 11, and these rollers 12 spin against the outer peripheral surface of the work 4 when spinning the work 4, is described. However, the structure may also be such that the rollers 12 are fixed to the support shafts 11, and the rollers 12 slide against the outer peripheral surface of the work 4 when spinning the work 4.

Also, in the first and second example embodiments described above, a case in which an offsetting process is performed on the work 4 when spinning the work 4, is described. However, the invention is not limited to this kind of offsetting process. That is, a forming process that points the tube axis CT6 of the processed portion 4*b* of the work 4 in a given direction may also be performed. This enables a variety of members having complex cylindrical shapes to be integrally formed from the cylindrical work 4.

Moreover, the processed portion 4*b* of the work 4 may also be reduced in diameter by suitably reducing the revolution diameter of the rollers 12 with the forming process to point the tube axis CT6 of the processed portion 4*b* of the work 4 in a given direction. In this case, the forming process to point the tube axis CT6 of the processed portion 4*b* of the work 4 in the given direction and the diameter reducing process are performed simultaneously. As a result, productivity is able to be increased.

Also, in the first and second example embodiments described above, a case is described in which the first rollers 12A and the second rollers 12B are provided on separate support shafts 11 (i.e., the first support shafts 11A and the second support shafts 11B). However, the first rollers 12A and the second rollers 12B may also be provided on the same support shafts 11 as long as the plane of revolution PL1 of the first rollers 12A and the plane of revolution PL2 of the second rollers 12B are provided in different positions in the direction of the rotational axis CT1 of the spindle 10.

Also, in the first and second example embodiments described above, a spinning head 7 in which the plane of revolution PL1 of the first rollers 12A and the plane of revolution PL2 of the second rollers 12B are provided in different positions in the direction of the rotational axis CT1 of the spindle 10, i.e., a spinning head 7 provided with two tiers of rollers 12, is described. However, a spinning head 7 provided with three or more tiers of rollers 12 may also be used instead.

The invention is extremely useful when integrally forming a member having a three dimensionally complex cylindrical shape, more specifically, a surge tank, a separation tank of a turbocharger, a muffler for a two-wheel vehicle, a catalytic converter, a diesel exhaust treatment device (i.e., a diesel particulate filter), and various pressure containers and the like, from cylindrical material by spinning.

The invention claimed is:

1. A spinning apparatus comprising:

a work supporting portion that supports a supported portion of a cylindrical work, the work supporting portion including a base and a chuck on the base;

a first roller that is provided on a spinning head and that is pressed against a processed portion of the work while being revolved; and a second roller in which a plane of revolution thereof is provided in a different position, in a rotational axis direction of a spindle of the spinning head, than a plane of revolution of the first roller, wherein the first roller and the second roller work in cooperation with each other to retain the work;

the first roller and the second roller are pressed against the work while revolving, and the work supporting portion moves relative to the spinning head or the spinning head moves relative to the work supporting portion, while the work is being retained;

the spinning head includes a main shaft supported horizontally and a housing attached to the main shaft to rotate around an axis of the main shaft, an annular faceplate is fixed to the housing perpendicular to the axis of the main shaft, a slider is arranged on the faceplate to move in a radial direction of the faceplate, the slider rotatably supporting one of the first roller or the second roller, and the slider moves in the radial direction of the faceplate by pivoting a slide ring which rotates about a predetermined rotation axis.

2. The spinning apparatus according to claim 1, wherein the work supporting portion is configured such that an offsetting process, in which a tube axis of the processed portion of the work is offset from a tube axis of the supported portion of the work by the processed portion of the work being moved relative to the work supporting portion, is performed by the work supporting portion or the spinning head being moved.

3. The spinning apparatus according to claim 2, wherein the work supporting portion swings such that the tube axis of the processed portion of the work is inclined with respect to the tube axis of the supported portion of the work.

4. The spinning apparatus according to claim 1, wherein the work supporting portion swings such that a tube axis of the processed portion of the work is inclined with respect to a tube axis of the supported portion of the work.

5. The spinning apparatus according to claim 1, wherein the first roller is provided in plurality at substantially equiangular intervals on a circumference of a circle that is centered around the rotational axis of the spindle; and the second roller is provided in plurality at substantially equiangular intervals on a circumference of a circle that is centered around the rotational axis of the spindle, in a manner arranged alternately with the first rollers when viewed from the rotational axis direction of the spindle.

6. The spinning apparatus according to claim 1, wherein the first roller and the second roller are configured to be able to move independent of each other in a radial direction with respect to the rotational axis of the spindle.

7. The spinning apparatus according to claim 1, wherein the slide ring includes a central portion and two lateral portions extending from the central portion.

* * * * *